US008333209B2

(12) United States Patent
Daas et al.

(10) Patent No.: US 8,333,209 B2
(45) Date of Patent: Dec. 18, 2012

(54) LATTICE SUPPORTING FRAMEWORK

(75) Inventors: Kamal Daas, Tira Triengle (IL); Doron Livnat, BA Rotterdam (NL)

(73) Assignee: ProDelta Investments b.v., BA Rotterdam (NL)

( * ) Notice: Subject to any disclaimer, the term of this patent is extended or adjusted under 35 U.S.C. 154(b) by 202 days.

(21) Appl. No.: 12/311,404

(22) PCT Filed: Mar. 14, 2007

(86) PCT No.: PCT/EP2007/002260

§ 371 (c)(1),
(2), (4) Date: Mar. 26, 2009

(87) PCT Pub. No.: WO2008/037300

PCT Pub. Date: Apr. 3, 2008

(65) Prior Publication Data

US 2010/0071299 A1 Mar. 25, 2010

(30) Foreign Application Priority Data

Sep. 26, 2006 (DE) ..... 20 2006 014 789 U

(51) Int. Cl.
*E04H 15/48* (2006.01)

(52) U.S. Cl. ..... 135/143; 52/646; 52/637; 52/79.5; 135/144; 403/109.1

(58) Field of Classification Search ..... 52/646, 52/637, 79.5, 712, 713; 135/143, 144; 403/378, 403/379.1, 109.1, 109.2, 109.8
See application file for complete search history.

(56) References Cited

U.S. PATENT DOCUMENTS

| | | | | |
|---|---|---|---|---|
| 2,540,169 | A * | 2/1951 | Kanaval | 403/378 |
| 2,767,812 | A | 10/1956 | Boger | |
| 3,235,038 | A | 2/1966 | Nesslinger | |
| 3,354,596 | A | 11/1967 | Schafer | |
| 5,490,533 | A * | 2/1996 | Carter | 135/145 |
| 5,765,248 | A * | 6/1998 | Ono | 14/75 |
| 5,794,640 | A * | 8/1998 | Jang | 135/131 |
| 5,819,492 | A * | 10/1998 | Konicek | 52/641 |
| 6,055,999 | A * | 5/2000 | Grey | 135/147 |
| 6,158,187 | A * | 12/2000 | Nakajima | 52/646 |
| 6,161,359 | A * | 12/2000 | Ono | 52/651.1 |
| 6,321,501 | B1 * | 11/2001 | Ignash | 52/645 |
| 6,374,843 | B1 * | 4/2002 | Zou | 135/145 |
| 6,412,507 | B1 * | 7/2002 | Carter | 135/145 |
| 6,772,458 | B2 * | 8/2004 | Ellen et al. | 5/424 |
| 7,367,348 | B2 * | 5/2008 | Tsai et al. | 135/145 |
| 7,673,644 | B2 * | 3/2010 | Carter | 135/144 |
| 7,766,024 | B2 * | 8/2010 | Rottmann | 135/156 |

(Continued)

FOREIGN PATENT DOCUMENTS

DE 3832546 4/1989

(Continued)

*Primary Examiner* — William V. Gilbert
*Assistant Examiner* — Alp Akbasli
(74) *Attorney, Agent, or Firm* — Dilworth & Barrese, LLP

(57) ABSTRACT

A lattice support structure has lattice bars pivotally connected to one another and extending in the longitudinal direction of the lattice support structure as well as lattice bars connecting them, with the connecting lattice bars being connected directly or indirectly to the lattice bars extending in the longitudinal direction such that the spacing of the lattice bars extending in the longitudinal direction of the lattice support structure can be decreased on the inward folding of the lattice support structure and increased on the folding apart of the lattice support structure.

14 Claims, 11 Drawing Sheets

U.S. PATENT DOCUMENTS

| | | | | |
|---|---|---|---|---|
| 2002/0074031 | A1* | 6/2002 | Morgante et al. | 135/128 |
| 2003/0024203 | A1 | 2/2003 | Kuo | |
| 2004/0050008 | A1* | 3/2004 | Mintie et al. | 52/646 |
| 2004/0111999 | A1* | 6/2004 | Schipani et al. | 52/646 |
| 2009/0032079 | A1* | 2/2009 | Choi | 135/144 |
| 2009/0188540 | A1* | 7/2009 | Mallookis et al. | 135/143 |

FOREIGN PATENT DOCUMENTS

| | | |
|---|---|---|
| EP | 0390149 | 10/1990 |
| GB | 2063959 | 6/1981 |

* cited by examiner

LATTICE SUPPORTING FRAMEWORK

BACKGROUND OF THE INVENTION

The present invention relates to a lattice support structure having lattice bars pivotally connected to one another.

Lattice support structures are used, for example, in the form of constructions or as components of constructions which have to take over a support function or a carrying function. It is conceivable in this respect for the lattice support structures only having to be set up for a temporary time and having to be dismantled again for transport. It is also conceivable to provide lattice support structures which remain permanently in situ. It is disadvantageous in any case that known lattice support structures require a comparatively large amount of space since they have large cross-sections as a rule. These disadvantages do not only result on transport, but naturally also on the storage or other provisioning of the lattice support structures.

SUMMARY OF THE INVENTION

The object of the present invention is to further develop a lattice support structure of the initially named kind such that it is movable, starting from a folded apart operating position into an inwardly folded state, and conversely, from the inwardly folded state into the folded apart state.

This object is solved by a lattice support structure having the features of claim 1. Provision is accordingly made for the lattice support structure to have lattice bars extending in the longitudinal direction of the lattice supports structure and lattice bars connecting them, with the connecting lattice bars being connected directly or indirectly to the lattice bars extending in the longitudinal direction such that the spacing of the lattice bars extending in the longitudinal direction of the lattice support structure can be decreased on the inward folding of the lattice support structure and can be increased on the folding apart of the lattice support structure.

In this respect, the lattice bars extending in the longitudinal direction can form the outer edges of the lattice support structure. It is particularly advantageous for the connecting lattice bars to be disposed in the outer surfaces of the lattice support structure at least in the folded apart state of the lattice support structure.

It is, for example, conceivable to make the cross-section of the lattice support structure square or rectangular, with the outer edges of the lattice support structure being formed by the lattice bars extending in the longitudinal direction and with the connecting lattice bars extending in the side surfaces of the lattice support structure.

Provision is made in a further embodiment of the invention for the connecting lattice bars to be made in one part or also in multiple parts.

It is conceivable that first connecting lattice bars are provided which extend in the folded apart state of the lattice support structure in a first direction with respect to the lattice bars extending in the longitudinal direction and which comprise two or more than two parts directly or indirectly pivotally connected to one another and that second connecting lattice bars are provided which extend in the folded apart state of the lattice support structure obliquely to the lattice bars extending in the longitudinal direction, with two lattice bars extending in the longitudinal direction being connected to one another by at least one first lattice bar and at least one second lattice bar.

Provision is preferably made for two lattice bars extending in the longitudinal direction to be connected to one another by two second connecting lattice bars which are arranged such that they extend cross-ways in the folded apart state of the lattice support structure. Two lattice bars extending in the longitudinal direction are furthermore preferably connected to one another by two first connecting lattice bars.

Provision is made in a further embodiment of the invention for the second connecting lattice bars to have a two-part or multipart structure, with a first part being connected to the second part by means of a joint, for the two parts to be pivotable relative to one another, with the first part being arranged such that it is pivotably connected to the lattice bar extending in the longitudinal direction, and with connection struts being provided which comprise two or more than two parts pivotably relative to one another and which connect a second connecting lattice bar, i.e. a lattice bar extending obliquely, to a first connecting lattice bar and are pivotally connected to both lattice bars.

Provision can furthermore be made for the first connecting lattice bars to extend perpendicular or substantially perpendicular to the lattice bars extending in the longitudinal direction in the folded apart state of the lattice support structure.

The named connection strut can be connected to the joint which connects the first part to the second part of an obliquely extending lattice bar.

The joint by means of which the first part of an obliquely extending lattice bar is connected to its second part can be made such that only a pivot movement, preferably a pivot movement away from the adjacent lattice bar extending in the longitudinal direction is possible. An inward folding of this section of the second obliquely extending lattice bar is thus only possible away from the adjacent lattice bar extending in the longitudinal direction in this embodiment. The joint thus not only forms a pivotable connection of the parts of the obliquely extending lattice bar, but also defines the end position of the pivot movement or the folding apart movement of the second connecting lattice bars.

It is conceivable that the first or the second part has a groove and a groove base and that the other part has a projection which is pivotably received in the groove, with the groove base bounding the pivot angle of the projection.

It is, for example, conceivable that the two parts are pivotable with respect to one another such that they are disposed on a line in the outwardly pivoted and folded apart state of the lattice support structure and can be kinked by means of the joint on the folding together of the lattice support structure away from the lattice rod extending in the longitudinal direction.

The parts of the connection strut which can be pivoted with respect to one another can be pivotally connected to one another such that the parts are pivotable in a first spacing with respect to one another and are not pivotable with respect to one another in a second spacing which is smaller than the first spacing.

It is inter alia possible in this manner to carry out locking in the folded apart state of the lattice support structure.

This can take place, for example, in that the first or the second part has a groove and the other of the parts has a bolt which is displaceably received in the groove, with the groove having a proximal and a distal end and with locking means being provided which prevents the parts from pivoting with respect to one another when the bolt is in the proximal end of the groove. A pivoting of the parts with respect to one another is thus no longer possible in the state of the bolt pushed into the groove. If the lattice support structure should be folded together, the spacing of the two parts with respect to one another increases and an inward folding of the connection strut is thus possible.

The two connecting lattice bars can be made in one part or in multiple parts.

It is conceivable that the second connecting lattice bars are not connected to one another at their point of intersection.

It is, however, also conceivable for the second connecting lattice bars to be connected to one another at their point of intersection.

Provision is made in a further embodiment of the invention for the lattice support structure to include one or more guide rods on which a sleeve is arranged longitudinally displaceably and to which second connection lattice bars are pivotally connected. It is, for example, conceivable that the lattice bars are made in two parts and are pivotably connected in their one end region to lattice bars extending in the longitudinal direction and are pivotably connected at their other end region to the named sleeve. The sleeve is moved in the longitudinal direction on the guide rod on the unfolding and folding closed of the lattice support structure. The guide rod preferably extends parallel to the lattice rods of the lattice support structure extending in the longitudinal direction.

Provision is made in a further aspect of the invention for the lattice support structure to have two-part or multipart lattice bars which are pivotally connected to the lattice bars extending in the longitudinal direction and connect them such that they form a triangle whose tip is formed by a joint connecting the two parts or more than two parts of the lattice bar.

It is feasible that two such lattice bars forming a triangle are provided which converge toward with one another or are arranged such that their tips extend in a directed manner with respect to one another in the state of the lattice support structure folded apart. It is possible to bolt the two triangles in the region of their tip in the folded apart state of the lattice support structure to ensure that these connecting lattice bars are loadable or maintain their position on strain.

Provision is made in a further embodiment of the invention for the second, obliquely extending lattice bars to be made in two parts or in multiple parts, with the two parts or more than two parts being connected to one another by means of a rotatable disk to which they are pivotally connected. It is, for example, conceivable that the obliquely extending lattice bars are made in two parts, with each of the parts being pivotably connected in an end region to the lattice bars extending in the longitudinal direction and being pivotably connected in the other end to the named disk.

It is particularly advantageous for two disks to be provided which can rotate in opposite senses and of which the parts of a lattice bar are pivotally connected to one disk and the parts of a lattice bar crossing it are pivotally connected to the other disk.

In a further embodiment of the invention, locking means are provided by means of which the rotation of the disks can be suppressed.

It is particularly advantageous in this respect for the locking means to be formed by a section of the named guide rod or by a component arranged thereat. Provision is preferably made in this respect for the guide rod—to be connected to the disks or to engage into them in the spread apart state of the lattice structure such that their rotation is not possible. If the structure should be folded together, the guide rod is moved such that it is no longer in engagement with the disk or disks so that said disks can be rotated and be released for the folding together of the structure or for the inward pivoting of the connecting lattice bars.

In a further embodiment of the present invention the folding and unfolding of the lattice bars takes place in two dimensions, i.e., regarding the cross section of the lattice support structure vertically and horizontally.

The present invention is further directed to a lattice support structure having lattice bars pivotally connected to one another, wherein the support structure has lattice bars extending in the longitudinal direction of the lattice support structure as well as further lattice bars being connected to the lattice bars extending in the longitudinal direction of the lattice support structure, wherein said further lattice bars form at least one pyramid structure within the space defined by the lattice bars extending in the longitudinal direction at least in the situation when the lattice support structure is folded apart. Those bars may further be able to form a pyramid structure in the position in which the lattice support structure has been folded together.

The further lattice bars forming the at least one pyramid structure may be pivotally connected with the lattice bars extending in the longitudinal direction of the lattice support structure.

In a preferred embodiment of the present invention the number of lattice bars forming a single pyramid structure corresponds to the number of lattice bars extending in the longitudinal direction of the lattice support structure. The lattice bars forming the pyramid structure may be linked to the lattice bars extending in the longitudinal direction in their end portion.

In accordance to a further embodiment of the present invention the peak of the pyramid structure is located in the centre of the lattice support structure. The pyramid structure, preferably the peak thereof may be connected with or may part of a mechanism for folding and unfolding the lattice support structure.

In accordance with a further embodiment of the present invention there may be provided pairs of pyramid structures which are directed in different longitudinal directions of the lattice support structure. Preferably those pairs of pyramid structures share the same base area. In this case the peaks of the pyramids are directed to different directions of the lattice support structure.

The present invention is further directed to a lattice support structure with structures which can be spread apart, in particular a lattice support structure in accordance with the description herein, wherein the lattice support structure has pivotally arranged lattice bars, wherein the pivot connection is made such that one of the parts pivotally connected to one another has a projection and in that the other one of the pivotally connected part has a groove which is bounded on three sides by walls and in which the projection of the other part is pivotally received.

The lattice bars may have the projection at their one end region and the groove at their other end or the lattice bars may have grooves or projections at their two end regions.

A braking device may be provided which is adapted to fix the lattice bars in a specific pivot position. The braking device may be made as a drum brake or as a shoe brake.

In accordance with a further embodiment of the present invention the shoe brake is arranged at one of the parts pivotally connected to one another and has two projections which, on the actuation of the brake, simultaneously come into contact with the other of the parts pivotally connected with one another.

BRIEF DESCRIPTION OF THE DRAWINGS

Further details and advantages of the invention will be explained in more detail with reference to an embodiment shown in the drawing. There are shown.

DESCRIPTION OF THE PREFERRED EMBODIMENTS

Figure 1:
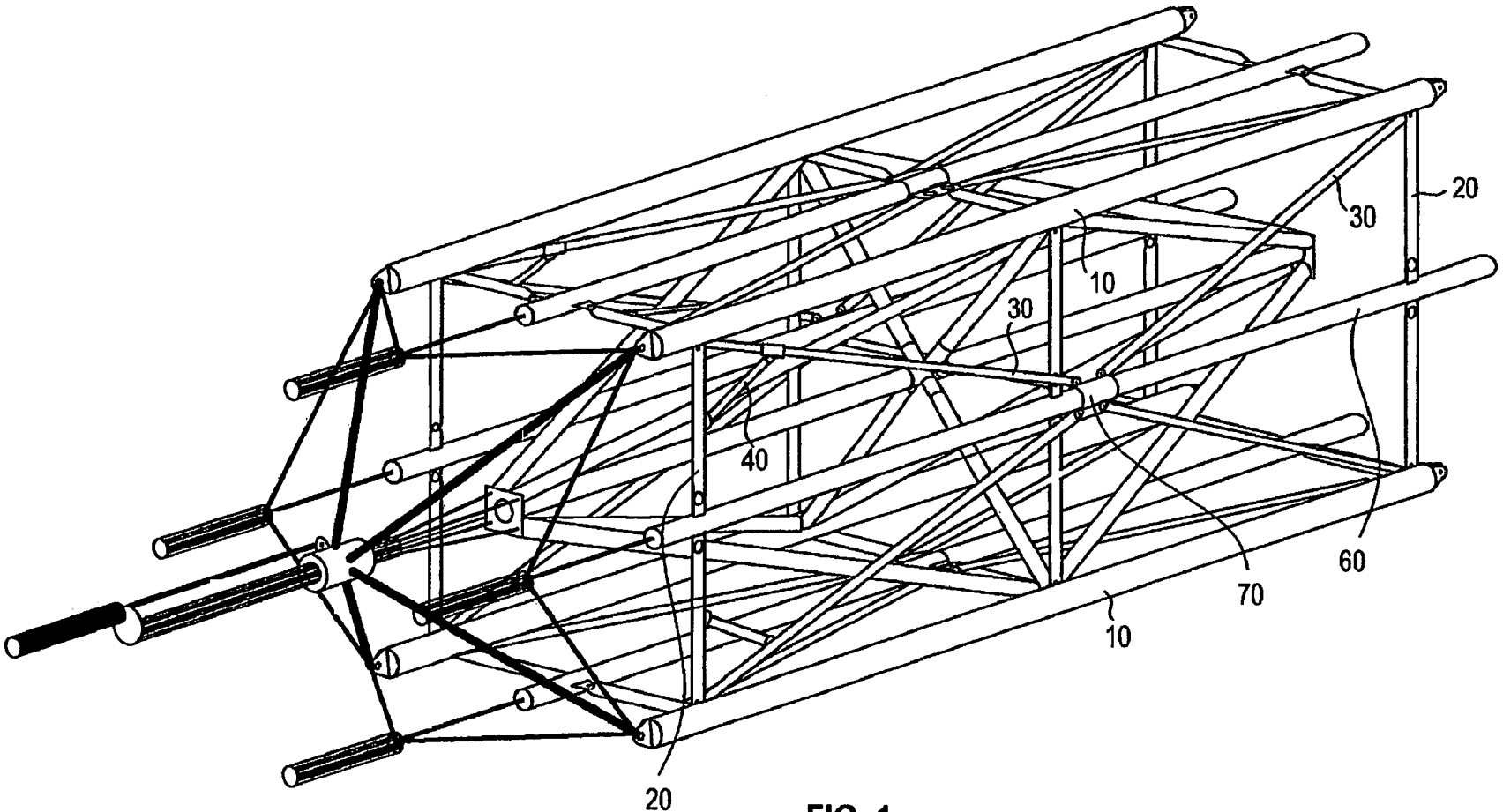
FIG. 1: a perspective representation of the lattice support structure in accordance with the invention.

FIG. 1 shows the lattice support structure in accordance with the invention which comprises individual segments of which one is shown in FIG. 1. The lattice bars shown on the left in FIG. 1 and marked by a dark color do not form part of the actual lattice support structure, but part of an apparatus for the erection and dismantling or for the folding apart and folding together of the lattice support structure.

The actual lattice support structure is quadrilateral in cross-section, with the corners being formed by lattice bars 10 which extend in the longitudinal direction and which extend parallel to one another. Two respective first connecting lattice bars 20 are located per surface on the four side surfaces of the lattice support structure, are made in multiple parts and are arranged pivotably at the lattice bars 10 extending in the longitudinal direction in one end region and can be pivotally connected to a guide bar 60 in their other end region whose function will still be explained later. The guide rod 60 is provided once per side of the lattice support structure and preferably extends on the side center parallel to the lattice rods 10 extending in the longitudinal direction. The first connecting lattice bars 20 extend perpendicular to the lattice rods 10 extending in the longitudinal direction as well as to the guide rod 60 in the folded apart state shown in FIG. 1. They are arranged in the two end regions of the lattice bars 10 extending in the longitudinal direction, as can be seen from FIG. 1.

The first connecting lattice rods and the second connecting lattice rods can preferably be loaded with tension and compression in the lattice support structure of the present invention.

Furthermore, a respective two second obliquely extending lattice rods 30 are located at each side of the lattice support structure and extend cross-ways, as can be seen from FIG. 1. These obliquely extending lattice rods 30 are likewise made in multiple parts and extend diagonally from the one end region of a lattice rod 10 extending in the longitudinal direction to the starting region of the parallel lattice rod 10 of the same side. The pivotal connection of the lattice rods 30 to the lattice rods 10 takes place in the same region as the pivotal connection of the lattice rods 20 to the lattice rods 10.

As can furthermore be seen from FIG. 1 and as will still be explained further below, the obliquely extending second lattice rods 30 are likewise made in multiple parts, with them being pivotably connected in one end region to the lattice rods 10 and in the other end region to the sleeve 70 which is longitudinally displaceably arranged on the guide rod 60.

Figure 2:
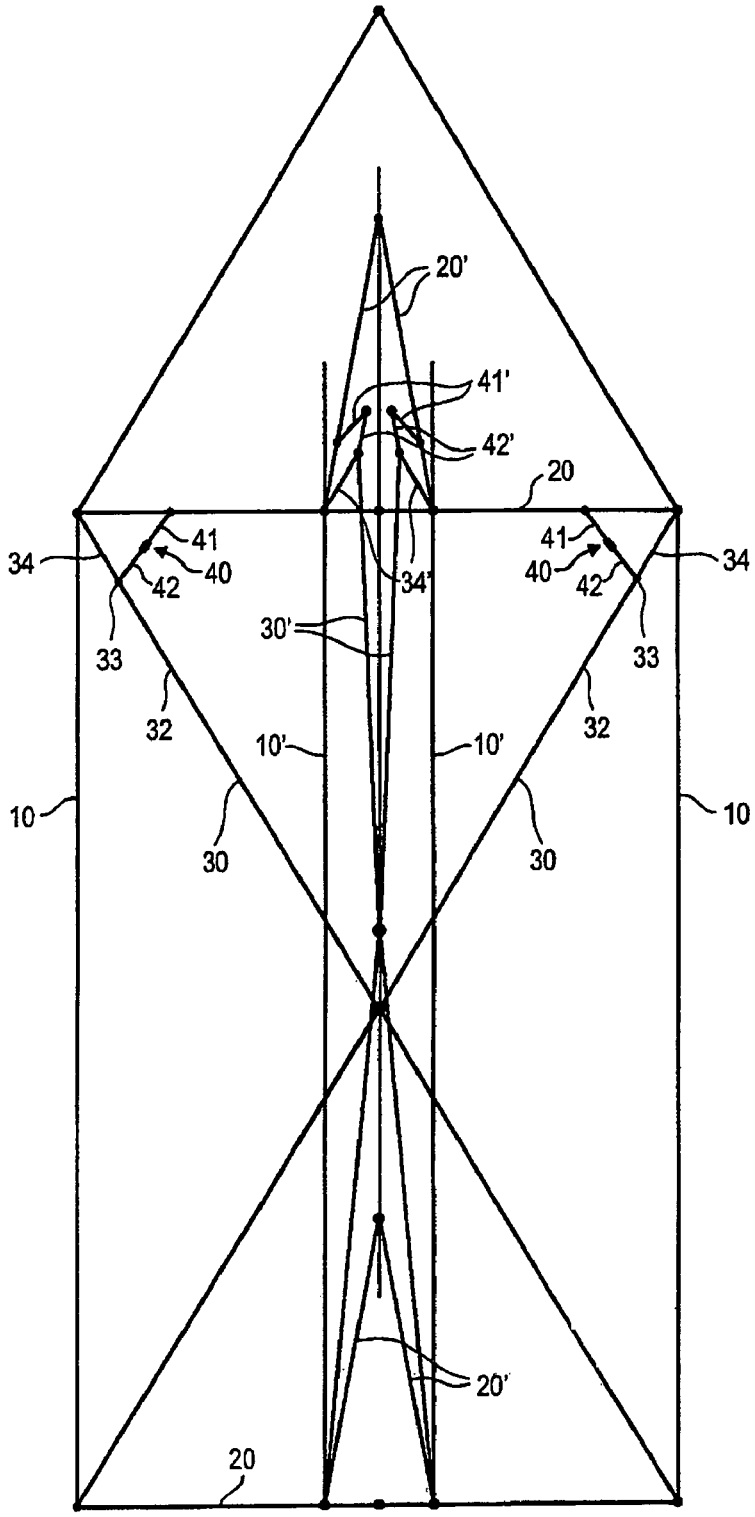
FIG. 2: a schematic representation of the lattice support structure in accordance with the invention.

FIG. 2 shows a schematic representation of a lattice support structure in accordance with the invention.

FIG. 2 shows the lattice support structure in two different positions of which one represents the folded apart position of the lattice support structure ready for operation and the other represents the inwardly folded position of the lattice structure, with the inwardly folded position being marked by reference symbols which are marked by a " " with respect to the position folded apart. As can be seen from FIG. 2 and as is shown in detail in FIG. 3, the lattice rods 30 consist of at least two sections 32, 34, with the section 34 being pivotally arranged at the lattice rod 10 extending in the longitudinal direction and being pivotably connected via a joint 33 to the other section 32 of the obliquely extending lattice rod 30.

Figure 5:
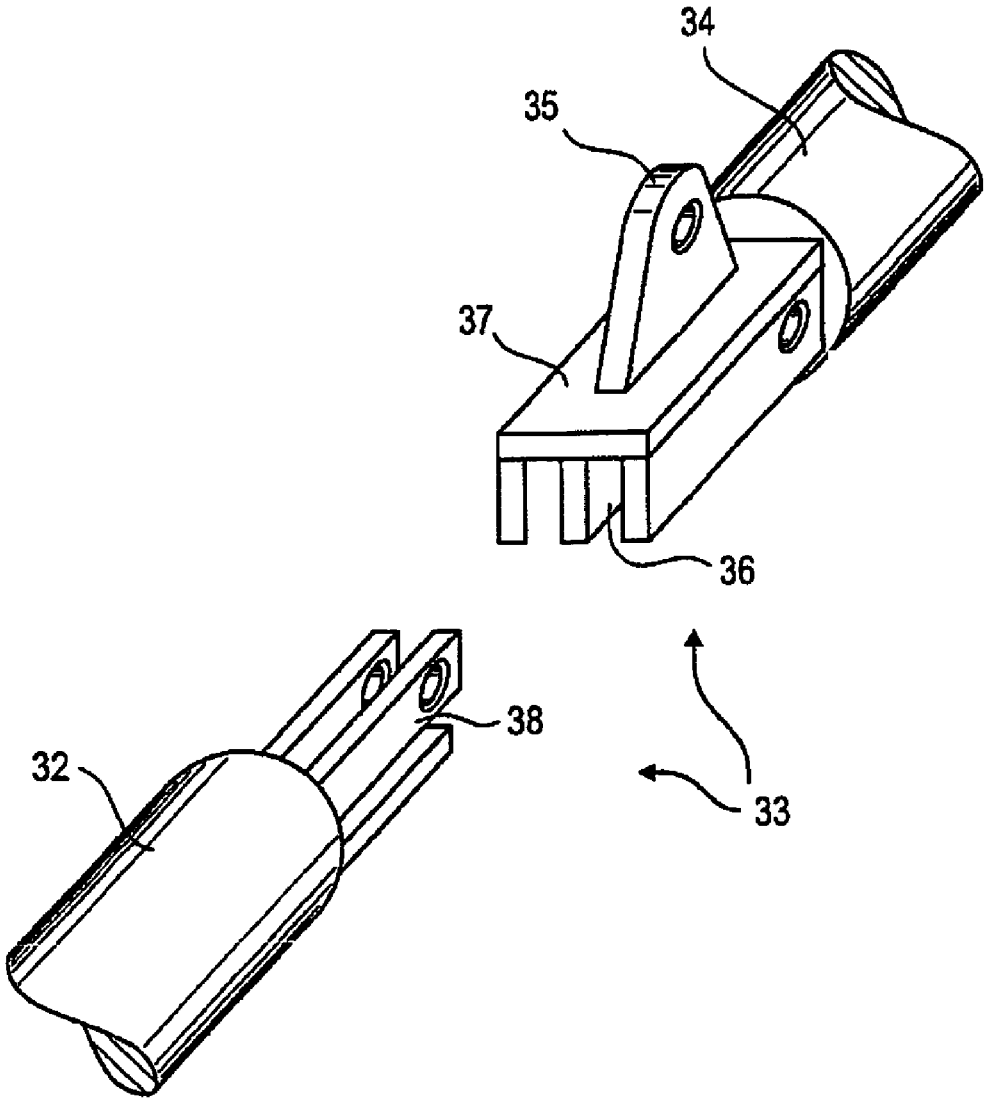

FIG. 5 shows the joint 33 in detail. The Figure illustrates that the part 34 has one or more grooves 36 which is open at one side and whose other side is closed by the groove base 37. The other one of the parts 32 has one or more projections 38 which can be introduced into the groove 36. After the introduction, the two parts are bolted to one another, for which purpose bores serve in the groove walls or in the projections 38. As can easily be see from FIG. 5, a pivotability of the two parts 32, 34 is only possible in one direction, namely only in the direction remote from the groove base 37. The groove base 37 in accordance with FIG. 5 prevents an upward pivoting of the part 32 with respect to the part 34.

Figure 3:
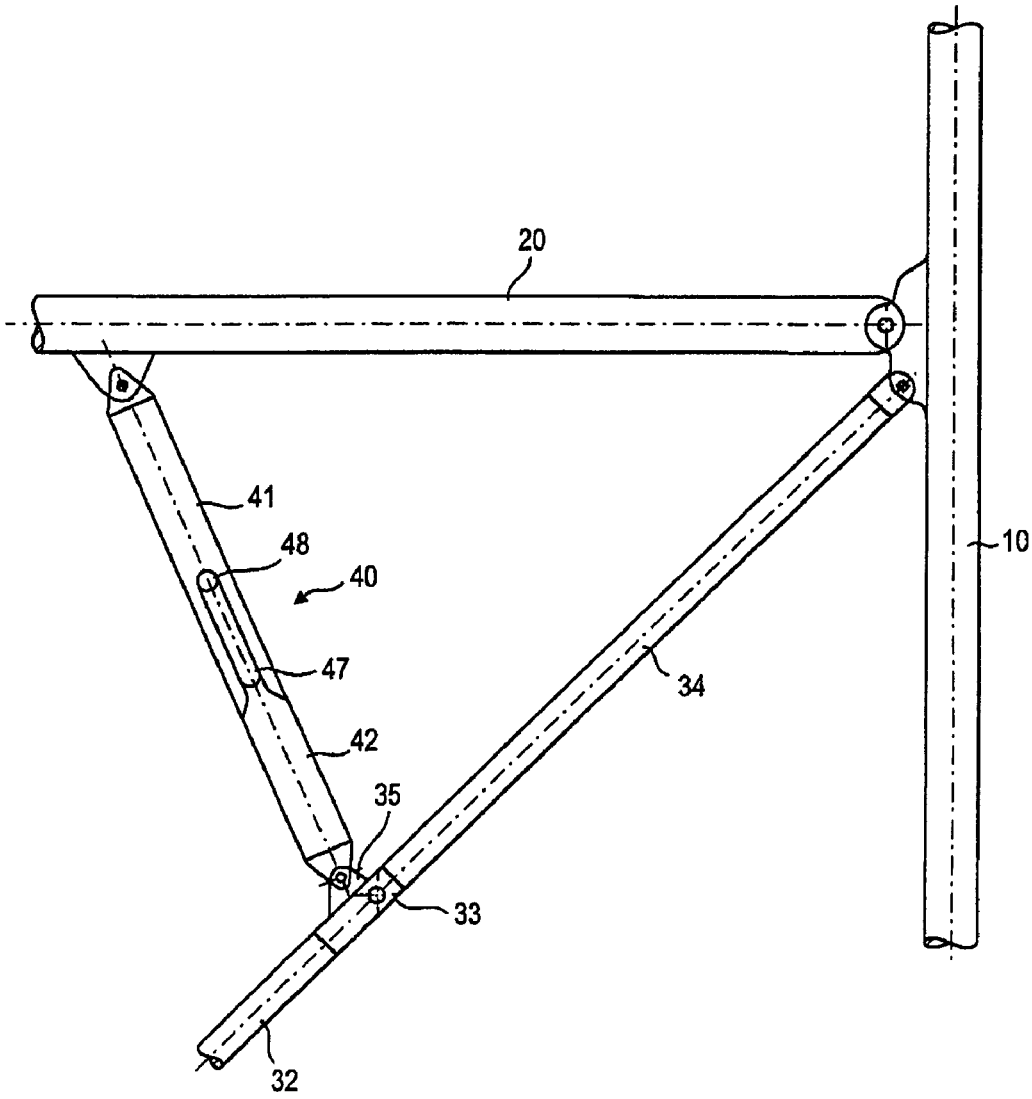
FIGS. 3 to 5: a detailed representation of the lattice support structure in accordance with FIG. 2.

The reference numeral 35 marks a lug by means of which a connection strut 40 is pivotally connected which can be seen from FIG. 3.

Figure 4:
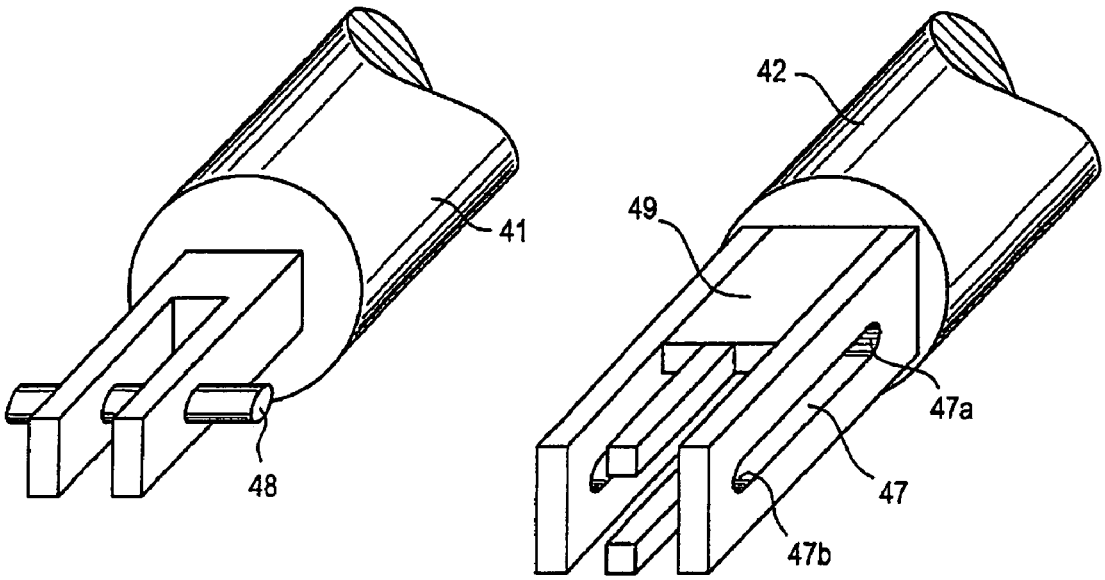

The connection strut 40, which is also shown in FIG. 2, is made in two parts and comprises the parts 41, 42. The connection strut 40 or its joint is shown in detail in FIG. 4. One of the parts of the connection strut has a bolt 48 which is longitudinally displaceably received in a groove 47 of the other part. The groove has a proximal end 47*a* and a distal end 47*b*. The part 41 has a projection which can be introduced into a groove of the other part 42. The bolt 48 is located in the front region of the projection, as can be seen from FIG. 4. If the bolt 48 is at the proximal end 47*a* of the groove 47, the plate 49 prevents the part 41 from being able to pivot relative to the part 42. If the bolt is, however, located outside this region, and in particular in the distal end region 47*b*, the projection of the part 41 can easily be moved relative to the part 42, i.e. an inward pivoting of the connection strut 40 is possible. In the state folded apart and ready for operation, the position of the strut 40 visible in FIG. 3 is thus locked by the arrangement of the joint of the connection strut visible from FIG. 4. This means that an inward pivoting of the connection strut is not possible in any direction. If the lattice support structure should be folded inwardly, the bolt 48 is moved out of the proximal end 47*a* of the groove 47 and an inward folding or inward pivoting of the connection strut 40 is possible.

As was stated above, FIG. 2 does not only show the folded apart state, but also the inwardly folded state of the lattice support structure. In the inwardly folded state, the first connecting lattice bars 20 are both shaped to form an acute-angled triangle. The same applies to the connection struts 40. The second part 34 of the obliquely extending lattice rod 30 also now extends at an acute angle to the first part 32 of the obliquely extending lattice rod 30.

The triangular linkage shown at the top in FIG. 2 already belongs to the subsequent segment of a lattice support structure.

Figure 6:
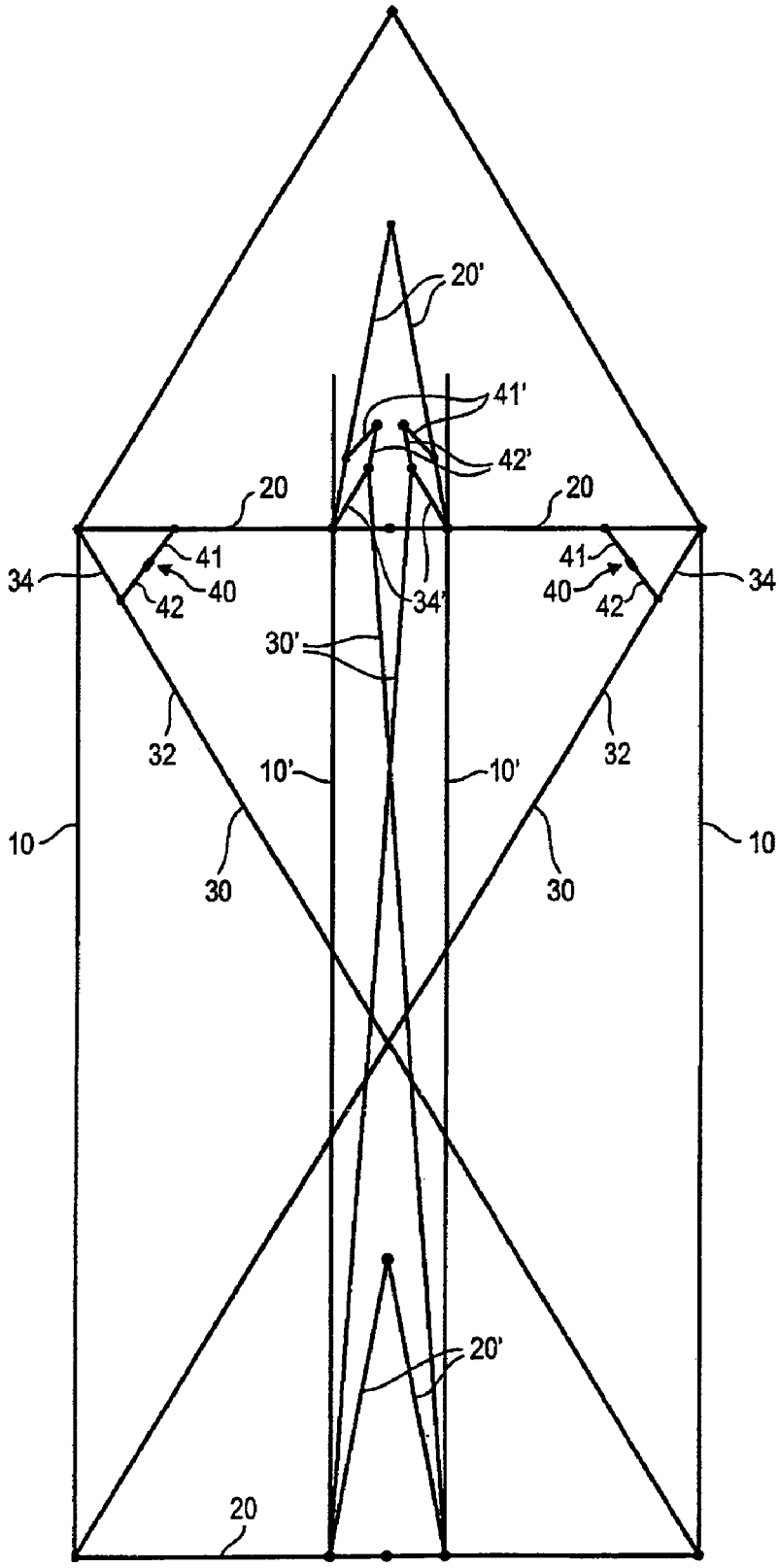
FIGS. 6 to 10: further aspects of the lattice support structure in accordance with the invention in schematic representations.

FIG. 6 shows an arrangement corresponding to FIG. 2, but which differs from FIG. 2 in that the obliquely extending lattice bars 30 are, unlike FIG. 2, not connected to one another.

Figure 7:
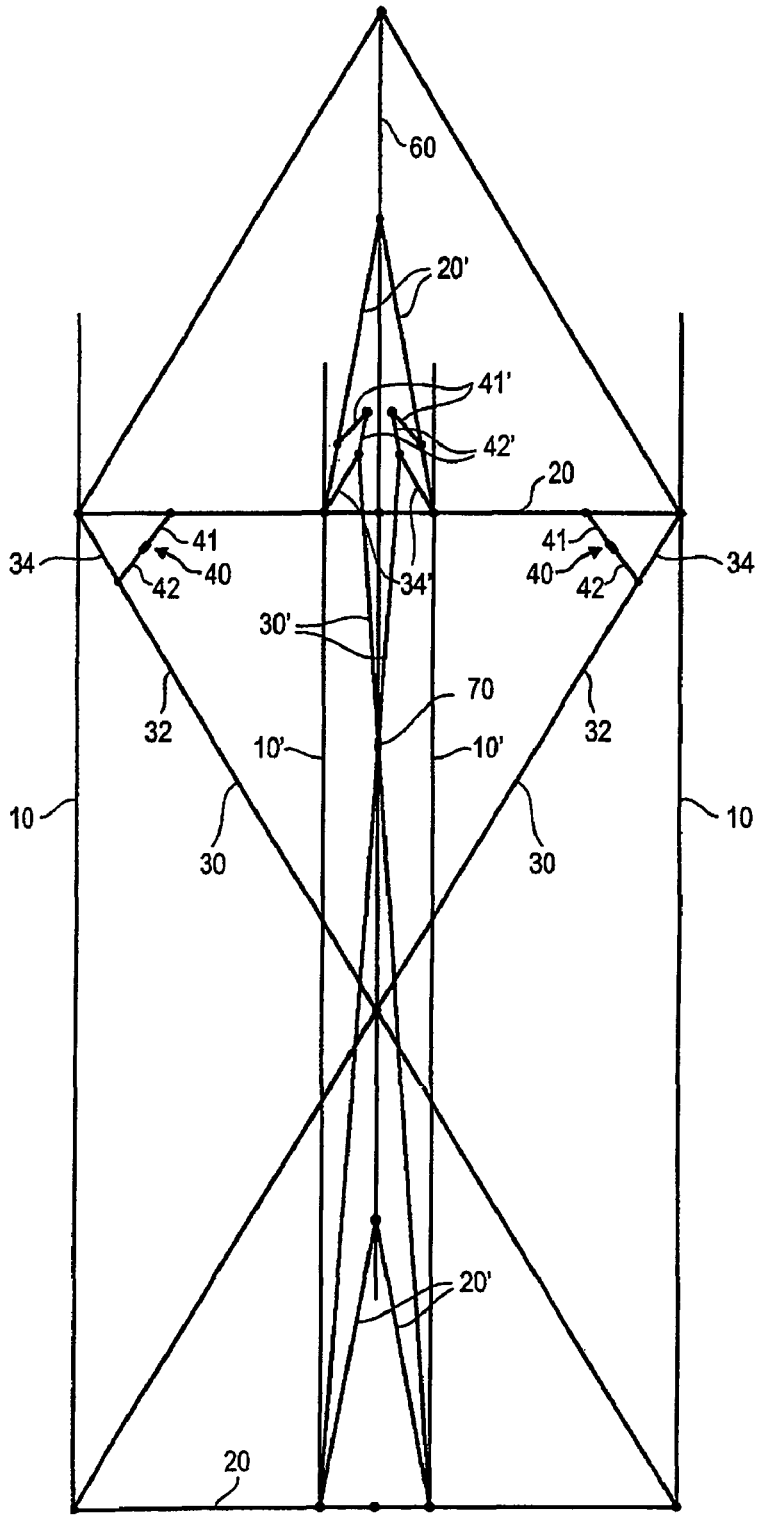

In contrast, FIG. 7 shows an embodiment in which the lattice bars 30 are connected to one another, and indeed via a sleeve 70 which is also shown in FIG. 1. The sleeve 70 runs on the guide rod 60 which is located approximately centrally to each of the sides of the lattice support structure. As can be seen from FIG. 1, the four end regions of the parts of the second lattice bars 30 extending cross-ways are pivotally connected to the sleeve 70. On the inward folding of the lattice support structure, the sleeve 70 is displaced on the guide rod 60, as is indicated in FIG. 7. At the same time, the first and second connecting bars 20, 30 as well as the connection strut 40 pivot inwardly.

Figure 8:
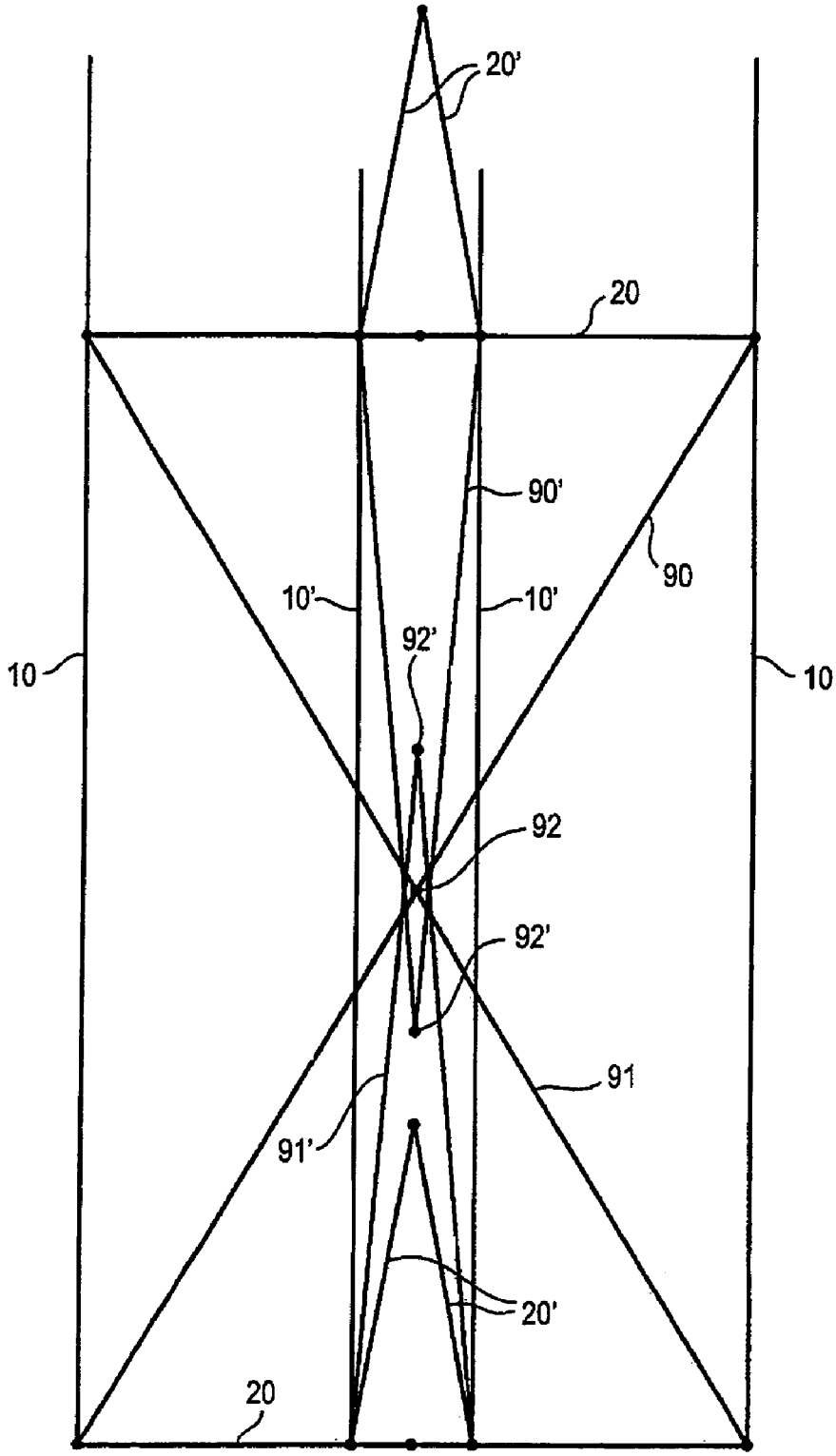

FIG. 8 shows an embodiment in which the lattice rods 90, 91 are made in two parts, with the two parts being pivotably connected to one another via a joint 92. The other end regions of the lattice bars 90 are each pivotably connected to one of the lattice bars 10 extending in the longitudinal direction, as can be seen from FIG. 8. The lattice bars 90 are pivotally connected in the same region of the lattice bars, as are the first lattice bars 20 which extend substantially perpendicular to the lattice bars 10 when the lattice support structure is folded apart.

As can furthermore be seen from FIG. 8, two such triangular structures are provided which converge toward one another. In the folded apart state of the lattice support structure, these triangular structures are bolted to one another at their tips to provide a loadable structure. The reference numerals 90', 91' mark the position of the lattice bars as well as of the joint with the inwardly folded state.

Figure 9:
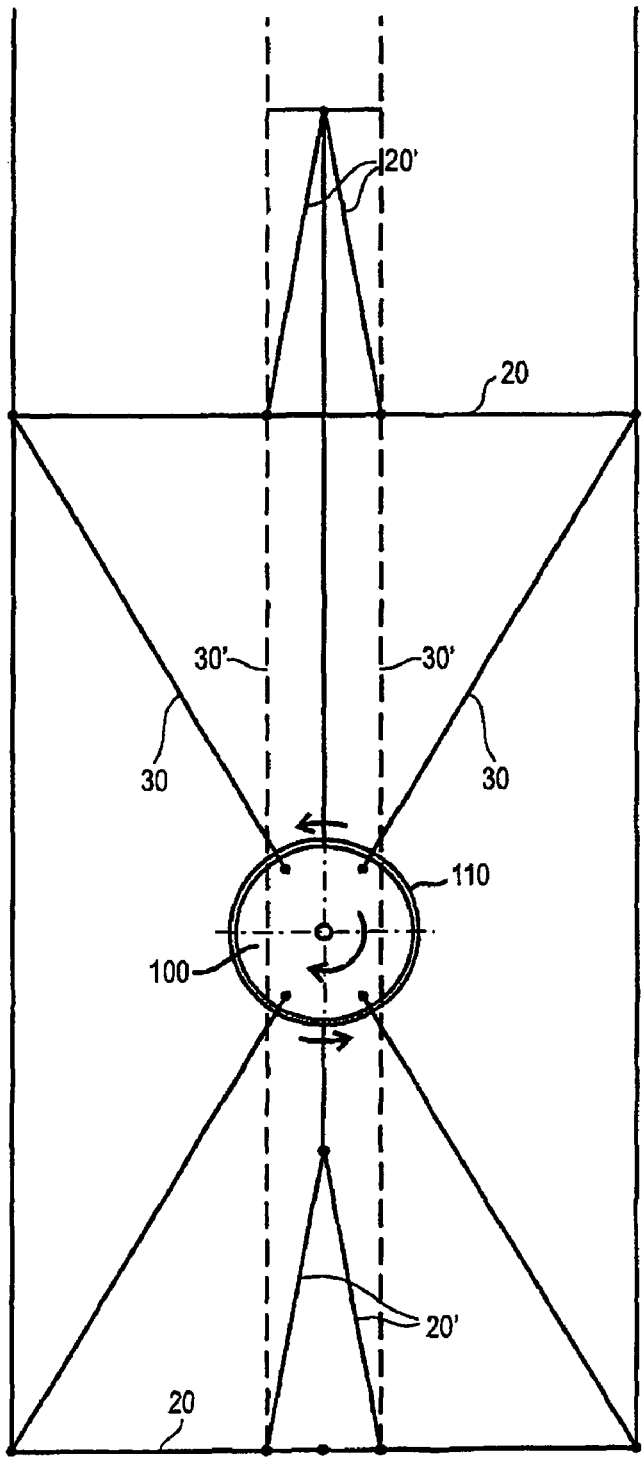

FIG. 9 shows an embodiment in which the obliquely extending lattice rods 30, i.e. the second lattice rods, are connected to one another via rotatable disks. In this respect, the obliquely extending lattice bars 30 are made at least in two parts, with one end region being connected to the lattice bars 10 and the other end region being connected to the disks 100, 110. The end regions of a lattice bar 30 are pivotably connected to a disk 100 and the end regions of the parts of the other lattice bar, which is cross-ways thereto, are pivotably connected to the other disk 110.

As can furthermore be seen from FIG. 9, the end regions of a lattice rod are each disposed in a diametrically opposite manner on the disk 100 and 110 respectively. If the lattice support structure should be folded inwardly, the disk 100 is clockwise in the present embodiment and the disk 110 is counter-clockwise, which has the result that the second obliquely extending lattice rods 30 are moved into the position shown by the reference numeral 30'. At the same time, the first lattice rods 20 are pivoted inwardly, as can likewise be seen from FIG. 9.

Figure 10:
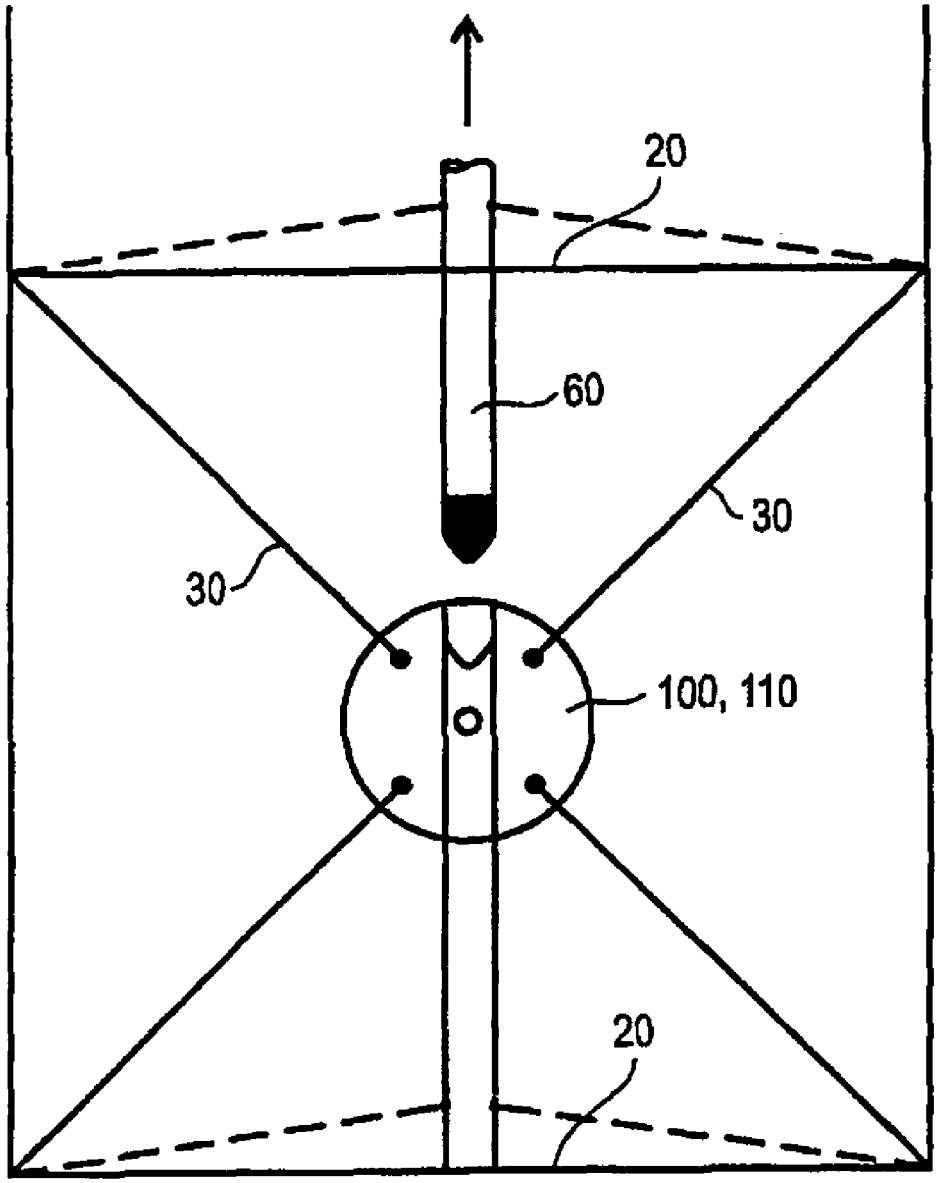

To prevent the disks 100, 110 from starting a rotary movement when the lattice support structure is erected, locking means are provided which are formed by the guide rod 60 in the embodiment in accordance with FIG. 10. A section thereof can engage into a cut-out of the disks 100, 110, which has the consequence that the disks 100, 110 are not rotatable. Only when the lattice support structure should be folded inwardly is the rod 60 moved upwardly in accordance with the direction of the arrow and is the locking thus released. The disks are now rotatable and the lattice bars can be pivoted inwardly.

FIG. 10 finally shows the lattice support structure in accordance with FIG. 1 in the inwardly folded state.

Figure 11:
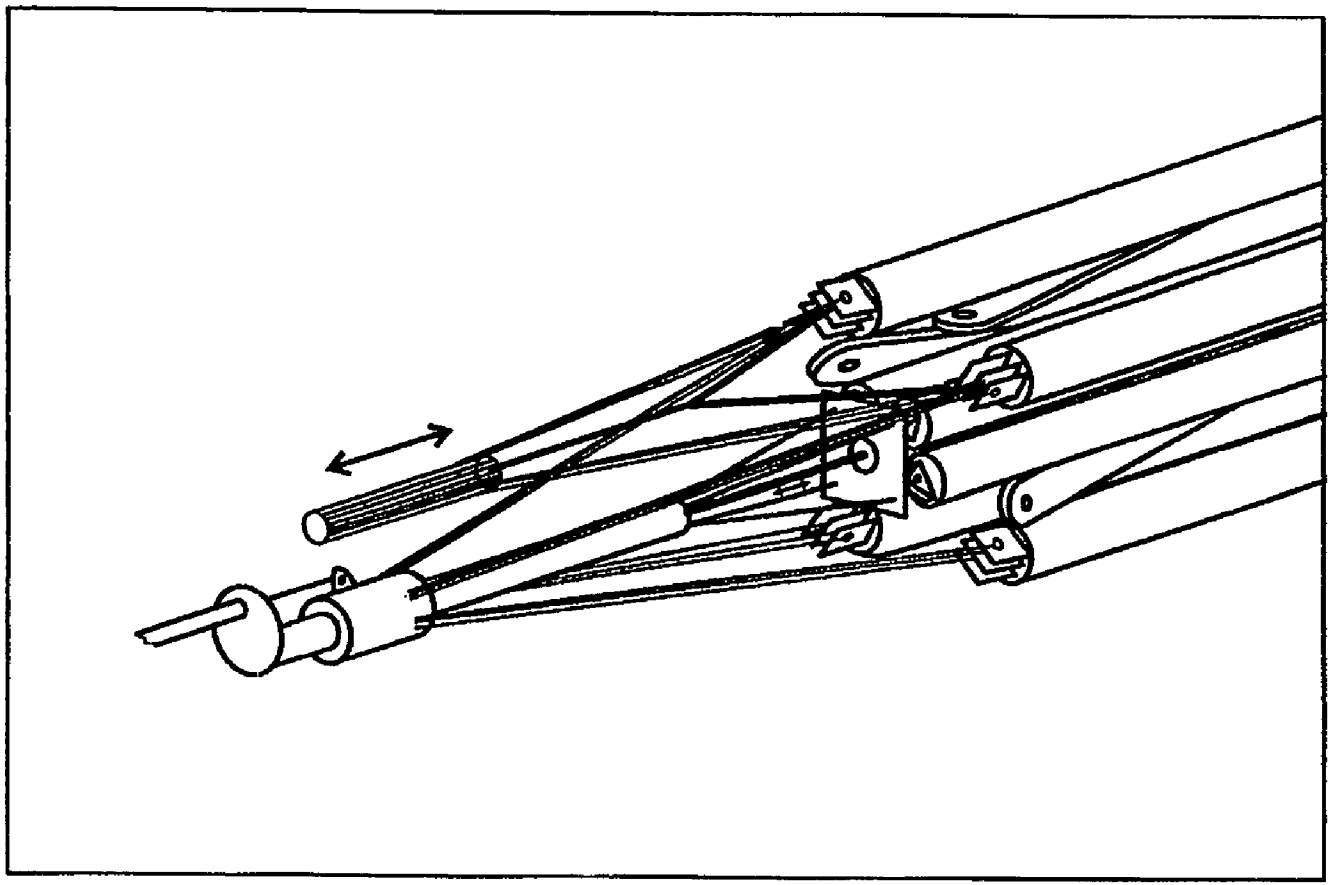
FIG. 11: a perspective representation of the lattice support structure in accordance with FIG. 1 in the folded together state.

As was stated above, an apparatus is shown in FIG. 1, left, as well as in FIG. 11 which serves for the erection or dismantling of the lattice support structure. Hydraulically operated piston-in-cylinder units of this apparatus engage at a central actuation rod at each of the guide rods 60 as well as at each of the lattice bars 1 extending in the longitudinal direction and forming the edges and exert a tension force or a compression force, that is, a force to the left or to the right in accordance with FIG. 1 or FIG. 11 depending on whether the lattice support structure should be folded apart or folded inwardly. The lattice support structure is thereby folded apart or folded inwardly. After the folding apart and locking, the apparatus is removed again and the next segment of the lattice support structure is erected. The individual segments are then connected to one another via bolt connections.

Provision can be made on the dismantling of the lattice support structure for a piston to be provided which acts on the apparatus shown in black for erection and dismantling such that it can only be moved comparatively slowly, which has the result for safety reasons that the lattice support structure is only folded together comparatively slowly.

The invention claimed is:

1. A lattice support structure having lattice bars pivotally connected to one another, wherein the lattice support structure has lattice bars (10) extending in the longitudinal direction of the lattice support structure as well as lattice bars (20, 30) connecting them, with the connecting lattice bars (20, 30) being connected directly or indirectly to the lattice bars (10) extending in the longitudinal direction such that the spacing oldie lattice bars (10) extending in the longitudinal direction of the lattice support structure can be decreased on the inward folding oldie lattice support structure and can be increased on the folding apart of the lattice support structure, wherein first connecting lattice bars (20) are provided which extend in a first direction toward the lattice bars (10) extending in the longitudinal direction in the folded apart state of the lattice support structure and which comprise two or more parts directly or indirectly pivotally connected to one another; and in that second connecting lattice bars (30) are provided which extend obliquely to the lattice bars (10) extending in the longitudinal direction in the folded apart state of the lattice support structure, with two lattice bars (10) extending in the longitudinal direction being connected to one another by at least one first connecting lattice bar (20) and at least one second connecting lattice bar (30), and wherein the second connecting lattice bars (30) are made in two parts or in multiple parts, with a first part (32) being connected to the second part (34) by means of a joint (33) in that the two parts (32, 34) are pivotable relative to one another, with the second part (34) being arranged such that it is pivotably connected to the lattice bar (10) extending in the longitudinal direction, and wherein connection struts (40) are provided which comprise two parts or more than two parts (41, 42) pivotable relative to one another and which connect a second connecting lattice bar (30) to a first connecting lattice bar (20) and are pivotally connected to both lattice bars (20, 30), wherein the joint (33) by which the first part (32) of a second connecting lattice bar (30) is connected to the second part (34) is made such that only a pivot movement away from the adjacent lattice bar (10) extending in the longitudinal direction is possible for an inward folding of the lattice support structure.

2. A lattice support structure in accordance with claim 1, wherein the lattice bars (10) extending in the longitudinal direction form the outer edges of the lattice support structure.

3. A lattice support structure in accordance with claim 1, wherein the connecting lattice bars (20, 30) are disposed in the outer surfaces of the lattice support structure at least in the folded apart state of the lattice support structure.

4. A lattice support structure in accordance with claim 1, wherein the connecting lattice bars (20, 30) are made in one part or in multiple parts.

5. A lattice support structure in accordance with claim 1, wherein two lattice bars (10) extending in the longitudinal direction are connected to one another by two second connecting lattice bars (30) which are arranged such that they extend cross-ways in the state of the lattice support structure bolded apart.

6. A lattice support structure in accordance with claim 1, wherein the first connecting lattice bars (20) extend perpendicular or substantially perpendicular to the lattice bars (10) extending in the longitudinal direction.

7. A lattice support structure in accordance with claim 1, wherein the first or second part (32, 34) has a groove (36) and a groove base (37); and the other part (34, 32) has a projection (38) which is pivotably received in the groove (36), with the groove base (37) bounding the pivot angle of the projection (38).

8. A lattice support structure in accordance with claim 1, wherein the second connecting lattice bars (30) are made in one part or in multiple parts.

9. A lattice support structure in accordance with claim 1, wherein the second connecting bars (30) are connected to one another at their intersection point.

10. A lattice support structure in accordance with claim 1, wherein the bars of the lattice support structures are linked so that folding and unfolding of the lattice support structure takes place in two dimensions.

11. The lattice support structure of claim 1 wherein the first part (32) of the second connecting lattice bar (30) is pivotably connected to a slider sleeve (70) arranged on a guide rod (60) or to one of the lattice bars (10).

12. A lattice support structure having lattice bars pivotally connected to one another, wherein the lattice support structure has lattice bars (10) extending in the longitudinal direction of the lattice support structure as well as lattice bars (20, 30) connecting them, with the connecting lattice bars (20, 30) being connected directly or indirectly to the lattice bars (10) extending in the longitudinal direction such that the spacing of the lattice bars (10) extending in the longitudinal direction of the lattice support structure can be decreased on the inward folding of the lattice support structure and can be increased on the folding apart of the lattice support structure, wherein first connecting lattice bars (20) are provided which extend in a first direction toward the lattice bars (10) extending in the longitudinal direction in the folded apart state of the lattice support structure and which comprise two or more parts directly or indirectly pivotally connected to one another; and in that second connecting lattice bars (30) are provided which extend obliquely to the lattice bars (10) extending in the longitudinal direction in the folded apart state of the lattice support structure, with two lattice bars (10) extending in the longitudinal direction being connected to one another by at least one first connecting lattice bar (20) and at least one second connecting lattice bar (30), and wherein the second connecting lattice bars (30) are made in two parts or in multiple parts, with a first part (32) being connected to the second part (34) by means of a joint (33) in that the two parts (32, 34) are pivotable relative to one another, with the second part (34) being arranged such that it is pivotably connected to the lattice bar (10) extending in the longitudinal direction, and wherein connection struts (40) are provided which comprise two parts or more than two parts (41, 42) pivotable relative to one another and which connect a second connecting lattice bar (30) to a first connecting lattice bar (20) and are pivotally connected to both lattice bars (20, 30), wherein the connection strut (40) is connected to the joint (33) which connects the first part (32) to the second part (34) of a second connecting lattice bar (30).

13. A lattice support structure having lattice bars pivotally connected to one another, wherein the lattice support structure has lattice bars (10) extending in the longitudinal direction of the lattice support structure as well as lattice bars (20, 30) connecting them, with the connecting lattice bars (20, 30) being connected directly or indirectly to the lattice bars (10) extending in the longitudinal direction such that the spacing of the lattice bars (10) extending in the longitudinal direction of the lattice support structure can be decreased on the inward folding of the lattice support structure and can be increased on the folding apart of the lattice support structure, wherein first connecting lattice bars (20) are provided which extend in a first direction toward the lattice bars (10) extending in the longitudinal direction in the folded apart state of the lattice support structure and which comprise two or more parts directly or indirectly pivotally connected to one another; and in that second connecting lattice bars (30) are provided which extend obliquely to the lattice bars (10) extending in the longitudinal direction in the folded apart state of the lattice support structure, with two lattice bars (10) extending in the longitudinal direction being connected to one another by at least one first connecting lattice bar (20) and at least one second connecting lattice bar (30), and wherein the second connecting lattice bars (30) are made in two parts or in multiple parts, with a first part (32) being connected to the second part (34) by means of a joint (33) in that the two parts (32, 34) are pivotable relative to one another, with the second part (34) being arranged such that it is pivotably connected to the lattice bar (10) extending in the longitudinal direction, and wherein connection struts (40) are provided which comprise two parts or more than two parts (41, 42) pivotable relative to one another and which connect a second connecting lattice bar (30) to a first connecting lattice bar (20) and are pivotally connected to both lattice bars (20, 30), wherein the parts (41, 42) of the connection strut (40) pivotable with respect to one another are pivotally connected to one another such that the parts are pivotable at a first spacing to one another and are not pivotable to one another at a second spacing which is smaller than the first spacing.

14. A lattice support structure having lattice bars pivotally connected to one another, wherein the lattice support structure has lattice bars (10) extending in the longitudinal direction of the lattice support structure as well as lattice bars (20, 30) connecting them, with the connecting lattice bars (20, 30) being connected directly or indirectly to the lattice bars (10) extending in the longitudinal direction such that the spacing of the lattice bars (10) extending in the longitudinal direction of the lattice support structure can be decreased on the inward folding of the lattice support structure and can be increased on the folding apart of the lattice support structure, wherein first connecting lattice bars (20) are provided which extend in a first direction toward the lattice bars (10) extending in the longitudinal direction in the folded apart state of the lattice support structure and which comprise two or more parts directly or indirectly pivotally connected to one another; and in that second connecting lattice bars (30) are provided which extend obliquely to the lattice bars (10) extending in the longitudinal direction in the folded apart state of the lattice support structure, with two lattice bars (10) extending in the longitudinal direction being connected to one another by at least one first connecting lattice bar (20) and at least one second connecting lattice bar (30), and wherein the second connecting lattice bars (30) are made in two parts or in multiple parts, with a first part (32) being connected to the second part (34) by means of a joint (33) in that the two parts (32, 34) are pivotable relative to one another, with the second part (34) being arranged such that it is pivotably connected to the lattice bar (10) extending in the longitudinal direction, and wherein connection struts (40) are provided which comprise two parts or more than two parts (41, 42) pivotable relative to one another and which connect a second connecting lattice bar (30) to a first connecting lattice bar (20) and are pivotally connected to both lattice bars (20, 30), wherein the first or second part (41, 42) has a groove (47) and the other of the parts (42, 41) has a bolt (48) which is displaceably received in the groove (47), with the groove (47) having a proximal end (47*a*) and a distal end (47*b*) and locking means (49) are provided which prevent a pivoting of the parts (41, 42) with respect to one another when the bolt (48) is located in the proximal end (47*a*) of the groove (47).

* * * * *